United States Patent [19]

Looney

[11] 4,087,087

[45] May 2, 1978

[54] SHEET STACKING APPARATUS FOR SORTER

[75] Inventor: John H. Looney, Fairport, N.Y.

[73] Assignee: Xerox Corporation, Stamford, Conn.

[21] Appl. No.: 763,274

[22] Filed: Jan. 27, 1977

[51] Int. Cl.[2] ..... B65H 31/24; B65H 31/34

[52] U.S. Cl. ..... 271/173; 271/80; 271/220

[58] Field of Search ..... 271/173, 80, 178, 220, 271/64, 213, 177, 69; 270/58

[56] References Cited

U.S. PATENT DOCUMENTS

| | | | |
|---|---|---|---|
| 2,753,185 | 7/1956 | Johnson | 271/220 |
| 3,087,724 | 4/1963 | Snowdon et al. | 271/220 X |
| 3,561,754 | 2/1971 | Gaffron et al. | 271/173 |
| 3,788,640 | 1/1974 | Stemmle | 271/173 |

*Primary Examiner*—Bruce H. Stoner, Jr.

[57] ABSTRACT

A multi-bin sorter comprised of bin arrays with each bin array comprised of a series of vertically oriented bins with an elevator to selectively raise and lower the bins to bring the individual bins into operative juxta position with an inlet station. Sheet stacking apparatus is provided for each of the bins which registers individual sets of incoming sheets accurately in machine direction and preserves previously cross direction registration.

5 Claims, 7 Drawing Figures

SHEET STACKING APPARATUS FOR SORTER

BRIEF SUMMARY OF THE INVENTION

This invention relates to an improved sorting system, and more particularly, to a moving bin sorter which has a sheet stacking apparatus associated with each bin to register individual sets accurately.

With the advent of higher speed and more sophisticated copy producing machines, printing presses, and the like, considerations as to how the mass of copies generated can best and most effectively be handled has assumed increasing importance. One way has been to provide a sorter at the machine output, the sorter serving to place the copies in accordance with a selected program in various bins of the sorter. While sorters as known to the art have taken various and sundry forms, many suffer from an inability to provide or permit a relatively uninterrupted operational system. This is in the sense that the feed of sheets to the sorter must be interrupted when the sorter has been filled and while unloading of the sorter takes place. Where, for example, the source of sheets to be sorted is relatively high speed copying machine, the machine must be stopped during this period with attendant loss in production time.

A problem arising with present sorting machines is that the stacking of sheets into individual bins is not entirely satisfactory from the standpoint of achieving proper registration of sheets forming an individual set without requiring additional time of a machine operator and/or machine downtime.

It is therefore a principal object of the present invention to provide a new and improved sorting apparatus.

It is a further object of the present invention to enhance the delivery of copy sheets to a moving bin sorting apparatus.

It is an object of the present invention to achieve proper registration of copy sheets received in moving bins simply and reliably.

It is another object of the present invention to ensure that copy sheets received in moving bins do not rebound in any direction or remain airborne thereby impeding a succeeding sheet.

BRIEF DESCRIPTION OF THE DRAWINGS

Other objects and advantages will be apparent from the ensuing description and drawings in which.

DETAILED DESCRIPTION OF THE INVENTION

Figure 1:
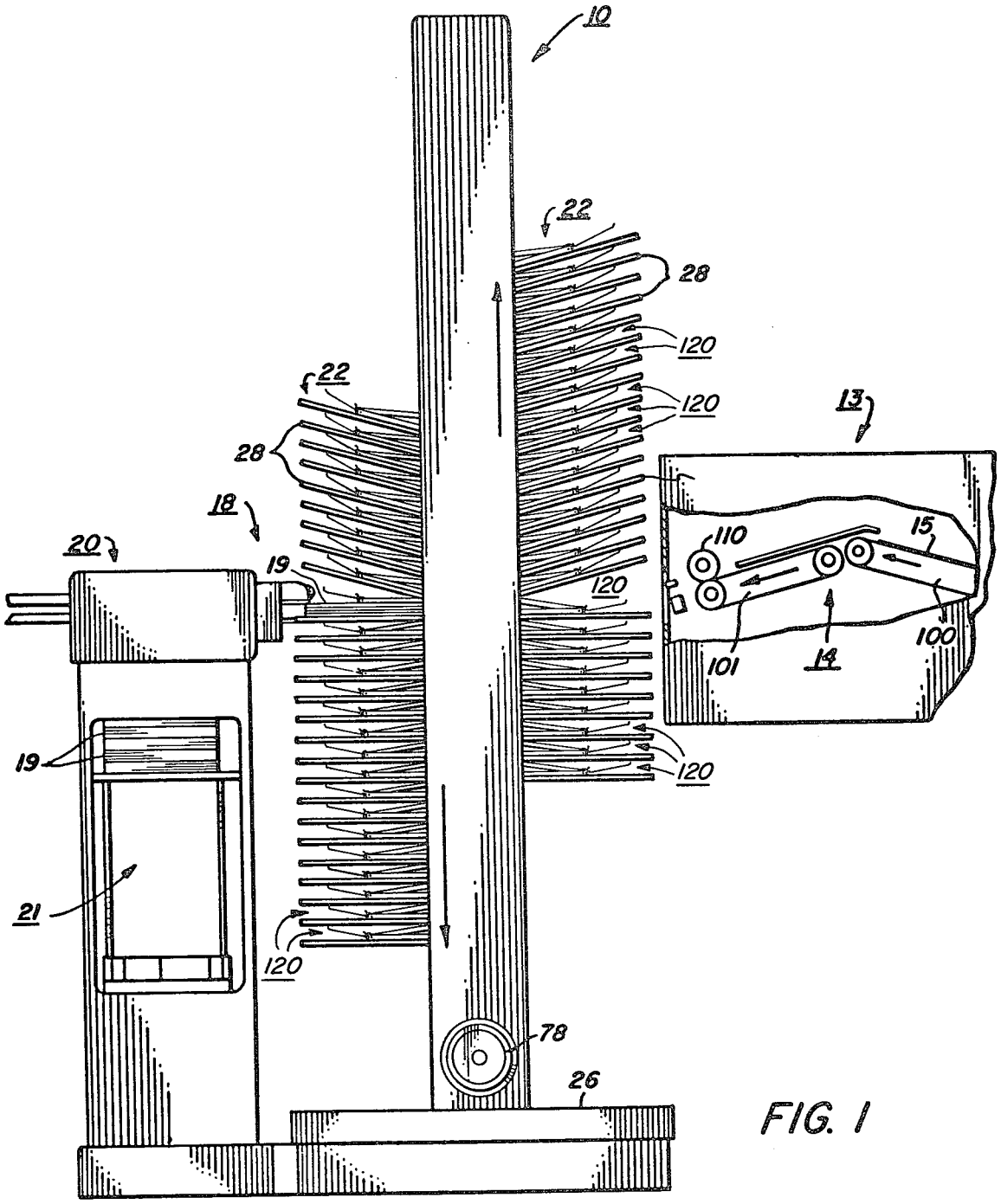
FIG. 1 is a side view schematic of a sorting system incorporating a sheet stacking apparatus according to the present invention.
Figure 2:
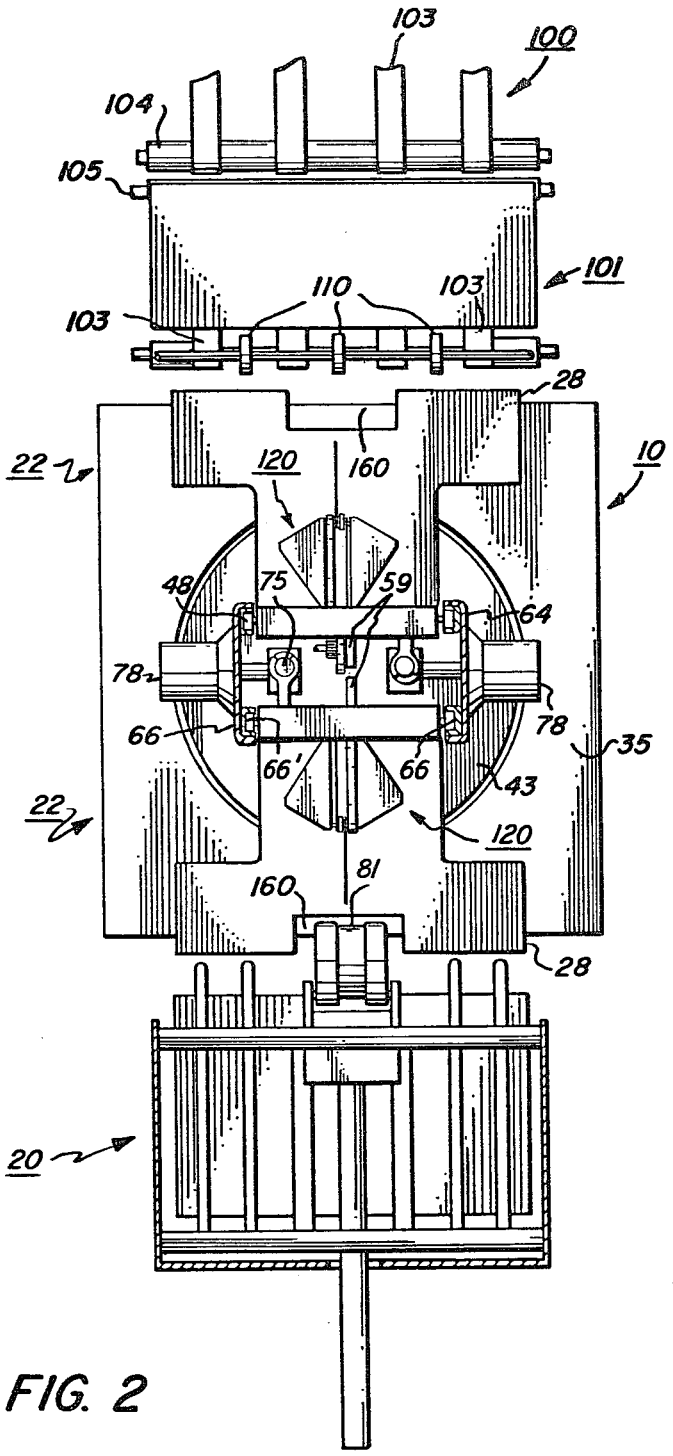
FIG. 2 is a top view schematic of the system shown in FIG. 1.

Referring particularly to FIGS. 1 and 2 of the drawings, the sorter of the present invention there shown is designated generally by the numeral 10 and is similar to that described in U.S. Pat. No. 3,995,748 to Looney which is commonly assigned herewith. Sorter 10 forms an integral part of an on-line finishing system which includes a source of sheets to be sorted, such as a copier or duplicator (not shown), a sorter loading station 13 including transport 14 for transporting sheets 15 to be sorted from the copier to sorter 10, and a sorter unloading station 20 including clamp 18 for withdrawing the packs 19 of sheets from the sorter bins and stacking elevator 21 for receiving the sheet packs 19.

Sorter 10 comprises a pair of bin arrays 22 disposed back to back with the bins entrances facing outwardly. Bin arrays 22 are supported in a substantially vertical posture upon a rotatable base or turntable 26. Each bin array 22 comprises a series of discreet sheet receiving trays 28 supported for substantially vertical up and down movement in unison on turntable 26. As a result, the individual trays 28 are brought into operative juxtaposition with the outlet of loading station 13 and the inlet to unloading station 20 for loading and unloading, respectively.

Figure 3:
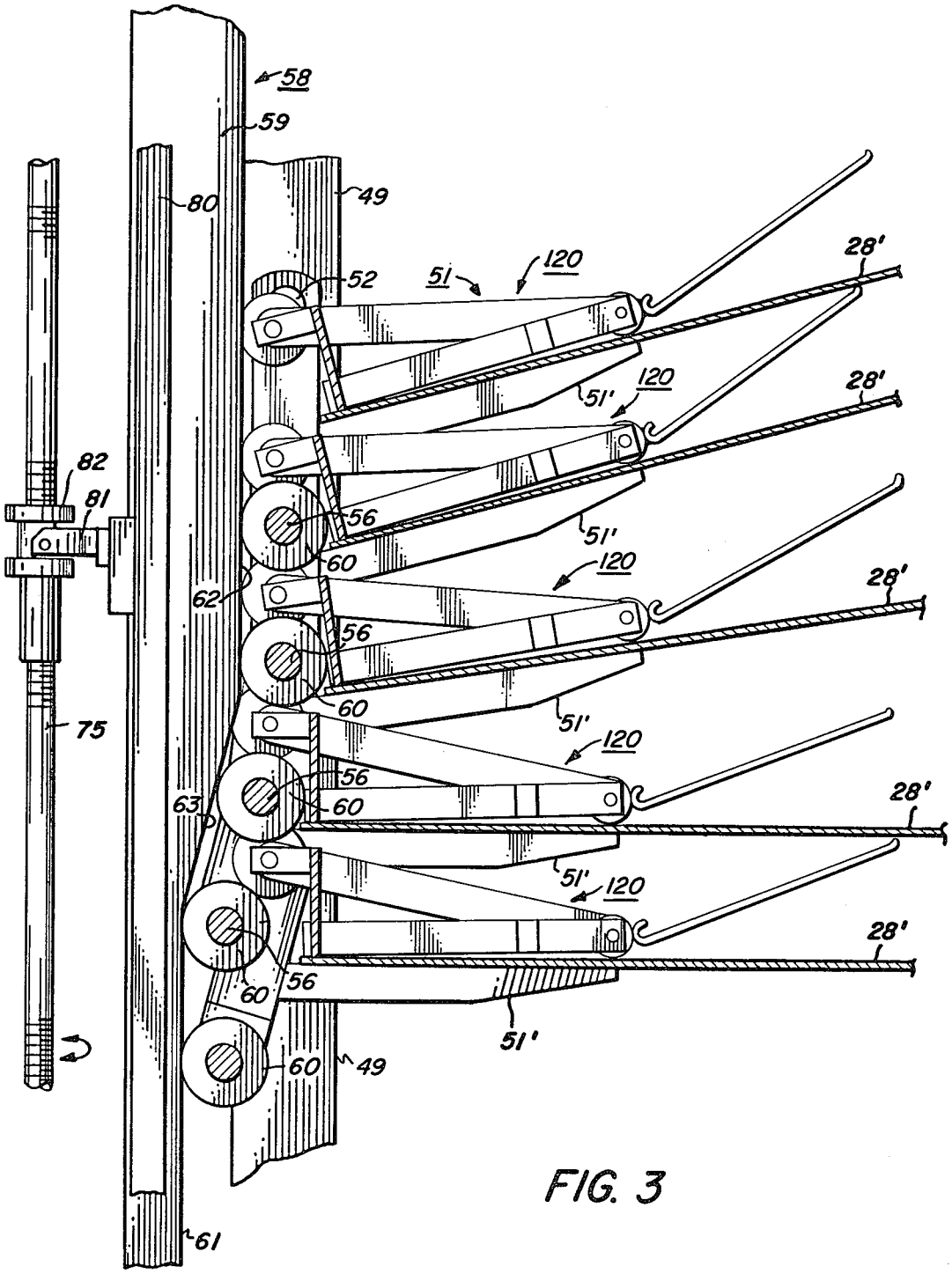
FIG. 3 is an enlarged view in cross section and with parts broken away showing details of the bin and tray operating mechanisms for the sorter shown in FIG. 1.
Figure 4:
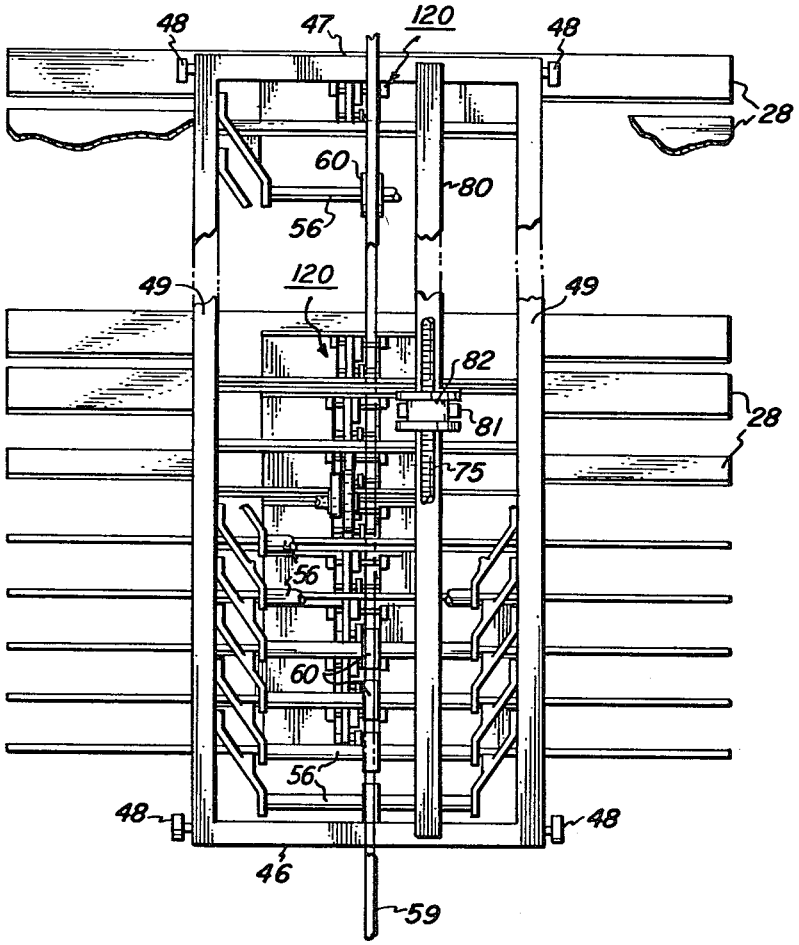
FIG. 4 is a rear view of one sorting array for the sorter shown in FIG. 1.
Figure 5:
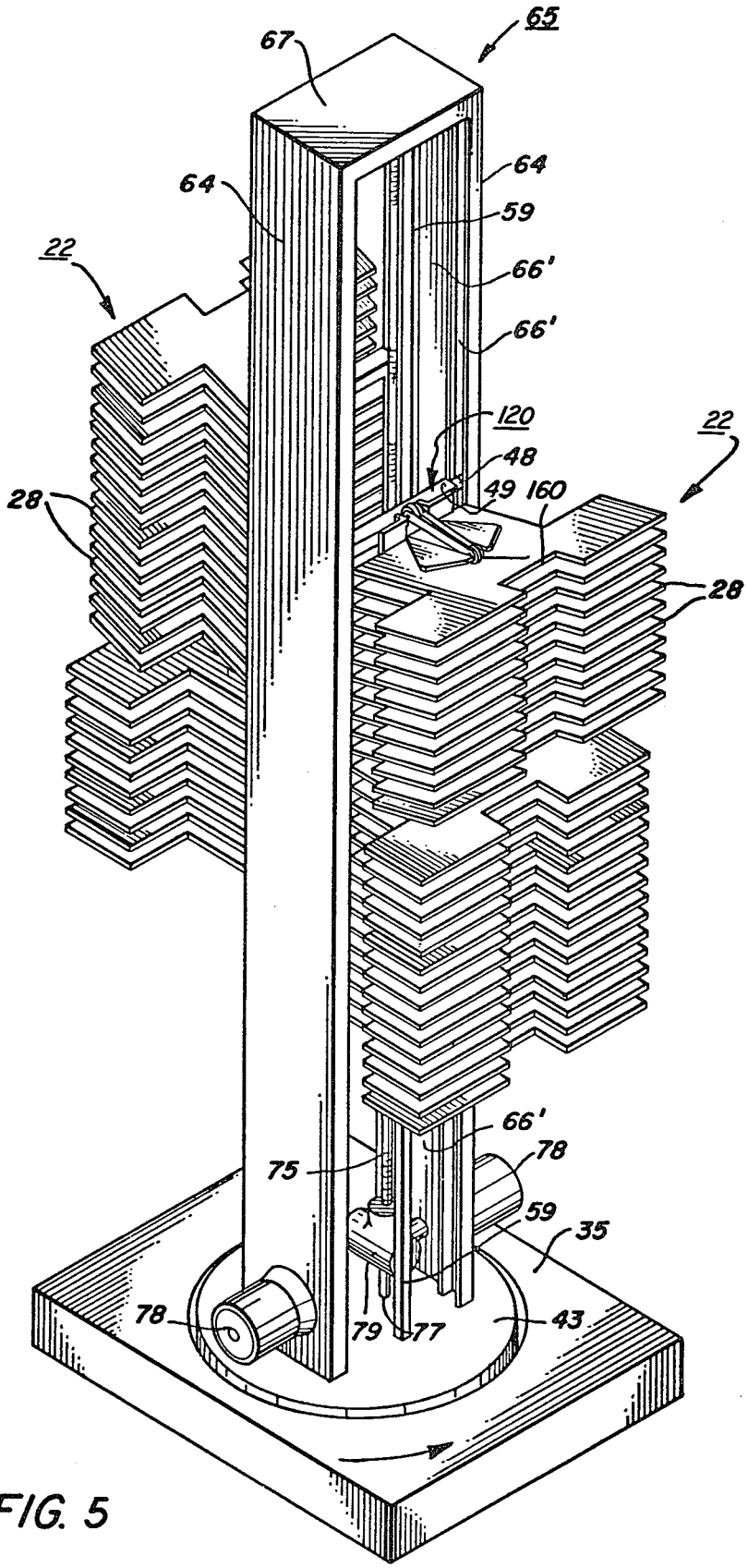
FIG. 5 is an isometric view showing details of the center support for the sorter shown in FIG. 1.

Referring to FIGS. 3–5, bin arrays 22 each have a generally rectangular frame like support structure comprised of bottom and top cross members 46, 47 and vertical side members 49. Side members 49 carry upper and lower mounting wheels 48 which ride in tracks 66' of channels 66.

A tower assembly 65 includes a pair of spaced side supports 64. A pair of channel-shaped members 66 are arranged within each support 64 with the open channel section of each channel 66 facing inwardly to provide a track 66' within which wheels 48 of bin arrays 22 ride. An upper cross support 67 is provided between the support tracks 66.

The individual trays 28 that comprise each bin array 22 are pivotally attached to side members 49 of the bin array frame by means of a pair of T-shaped supports 51. Each support 51 has the projecting leg portion 1' secured to the tray underside adjacent each side 51'with one end of the T-section pivotally attached to the adjoining side member 49 by pin 52. The opposite branch of the support T-section 51, has an opening therein within which a cross axle 56 is disposed. Axle 56, which extends between each pair of supports 51, carries a roller type follower 60 which rides on cam track 58 of a vertical cam member 59. As will appear, cam and follower 58, 60 control the angular disposition of trays 28. Cam member 59 is supported between plate 43, and cross support 67, it being understood that a cam member 59 is provided for each bin array 22 as part of tower assembly 65.

Tower assembly 65 includes a threaded drive member 75 for each bin array 22. Each drive member 75 is supported in upper and lower bearing blocks 77 mounted on cross support 67 and plate 43 respectively. A reversible drive motor 78 is provided for each bin array, motors 78 being mounted on side supports 64 of tower assembly 65 adjacent the bottom thereof. Motors 78 are drivingly connected to their respective drive members by suitable shaft and gear means 79.

A bin drive bracket 80 is provided for each bin array 22, bracket 80 being conveniently secured to the bottom and top cross members 46, 47 respectively of the bin array frame. A drive yoke 81, secured to bracket 80, carries drive nut 82 which is threadedly engaged with drive member 75. The tower assembly 65 including threaded drive members 75, motors 78, and yokes 81 may be conveniently enclosed by a suitable decorative housing (not shown).

Cam track 58, which cooperates with followers 60 of each tray 28 to control the angle or disposition of trays 28, has lower and upper vertical sections 61, 62 with an inclined ramp 63 therebetween. As noted, the followers 60 of each tray 28 ride on cam track 58, to determine the tilt or angle of inclination of the tray associated therewith. Movement of each follower from one section 61 or 62 across ramp 63 to the other section 62 or 61 causes the tray 28 associated therewith to pivot or swing to a new position as shown in FIG. 3. As a result, the relative spacing between the leading or inlet edges 28' of adjoining or succeeding trays 28 as the followers thereof move over ramp 63 of cam track 58 is temporarily increased, resulting in an enlarged tray mouth. With ramp 63 of cam track 58 adjacent the outlet of loading station 13 and the inlet to unloading station 20, clamp 18, and enlarged tray mouth facilitates loading and unloading of the trays 28.

Figure 6:
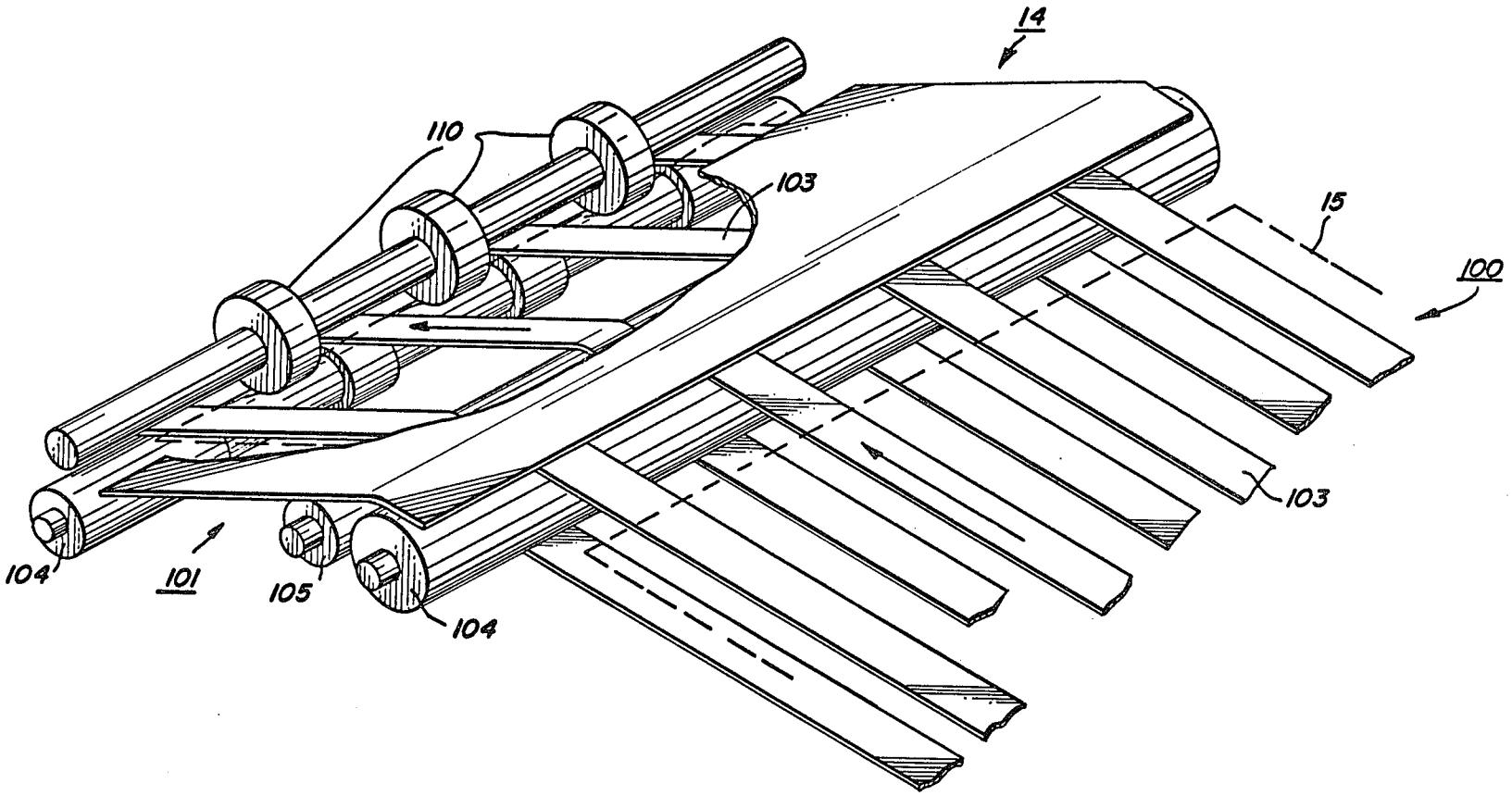
FIG. 6 is an isometric view of the inlet transport of the sorting system shown in FIG. 1.

Referring particularly to FIG. 6, inlet transport 14 of loading station 13 comprises a pair of conveyors 100, 101, each conveyor preferably consisting of multiple belts 103 stretched across supporting rolls 104, 105. Rolls 104 of conveyors 100, 101 may be conveniently driven to operate conveyors 100, 101 in the direction shown by the solid line arrow from a suitable power source (not shown). In that arrangement, rolls 105 function as idler rolls. Conveyors 100, 101 which are suitably supported between the outlet of the copier and the inlet to sorter 10, are driven at speeds suitable to bring the sheets discharged from the copier to sorter 10 in proper timed relationship to movement of the bin array 22 opposite thereto. To stiffen the sheets 15 in the direction of sheet travel and prevent sheet buckling, a stiffening roll set 110 is provided opposite rolls 104 of transport 101, rolls 110 being supported between rolls 104 with the roll peripheries overlaying each other. As a result, sheets 15 passing therebetween are bent or curved longitudinally to improve sheet stiffness.

Figure 7:
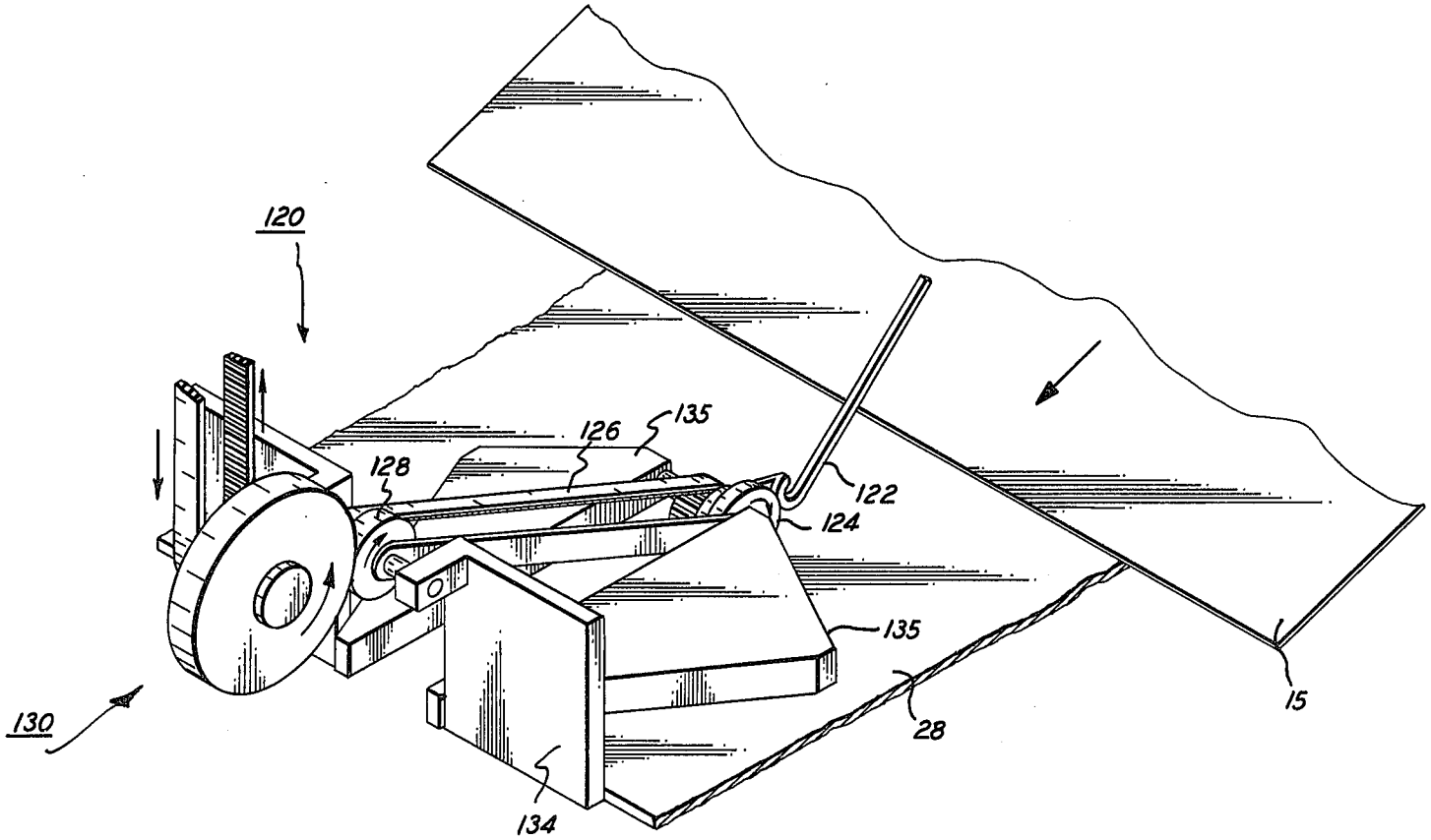
FIG. 7 is an isometric view showing details of the sheet stacking apparatus according to the present invention.

In accordance with the present invention, there is provided a sheet stacking mechanism which is an improvement for the sorter described by the above noted U.S. Pat. No. 3,995,748 which is incorporated by reference. The sheet stacking apparatus generally designated 120 is associated with each of the trays 28 to enable proper registration of sheets 15 received therein. As shown in FIG. 7, sheet stacking apparatus 120 includes guide bale 122 which directs incoming sheet 15 under wheel member 124. Wheel member 124 is driven at a speed slightly faster than the incoming sheet by a drive belt member 126 which in turn is driven by drive wheel member 128. Drive wheel member 128 is frictionally driven by driver 130 which is fixed to the base or frame.

It will now be appreciated that the moving wheel member 124 provides a friction surface to control the delivery of sheet 15 into the tray for registration against wall 134 of the tray. In order to effect anti-buckling control of the set of sheets received in a tray a pair of triangular members 135 are pivotally mounted on the axis of wheel member 124 to exert a weight distributed on the top of the stack or set of sheets thereby preventing the curl of sheets against the wall 134 of the tray.

In accordance with the above-described sheet stacking apparatus ensures proper stacking and registration of incoming sheets received in trays of a moving bin sorter. As a result, the sheets do not bounce or impede the delivery of the next incoming sheet. Thus, the sorting operation is greatly improved and the handling of sets facilitated.

While the invention has been described with reference to the structure disclosed, it is not confined to the details set forth, but is intended to cover such modifications or changes as may come within the scope of the following claims.

What is claimed is:

1. Sheet stacking apparatus for a moving bin sorter of the type receiving copy sheets in separately identifiable sets comprising a frame;

an array of bins moved relative to said frame past a sheet distributing station at which copy sheets are delivered to the bins, each of said bins having a wall member against which sheets can be registered, sheet stacking means associated with each of said bins for movement therewith including a driven rotary means positioned for applying a predetermined load on an incoming sheet and directing said sheet against said wall member, and drive means fixed to said frame and arranged to apply a driving force to each of said driven rotary means associated with said moving bins during the time each bin is adjacent the sheet distributing station to effect a predetermined force on said incoming sheets.

2. Apparatus according to claim 1 wherein said sheet stacking includes guide means for directing said incoming sheets below said rotary means.

3. Apparatus according to claim 2 including antibuckling members pivotally mounted on the same axis as said rotary means.

4. Apparatus according to claim 1 wherein said rotary means is driven through a belt member, said belt member being driven by roll means supported by said wall member.

5. Apparatus according to claim 4 including antibuckling members pivotally supported on the axis of said rotary means.

* * * * *